US007342543B2

(12) United States Patent
Bit-Babik et al.

(10) Patent No.: US 7,342,543 B2
(45) Date of Patent: Mar. 11, 2008

(54) ELECTRONIC DEVICE TO RECEIVE RADIO FREQUENCY SIGNALS

(75) Inventors: Giorgi G. Bit-Babik, Sunrise, FL (US); Antonio Faraone, Plantation, FL (US); Lorenzo A. Ponce De Leon, Lake Worth, FL (US)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/289,003

(22) Filed: Nov. 29, 2005

(65) Prior Publication Data

US 2007/0120746 A1 May 31, 2007

(51) Int. Cl.
*H01Q 1/24* (2006.01)
*H01Q 19/10* (2006.01)

(52) U.S. Cl. ..... 343/702; 343/818

(58) Field of Classification Search ..... 343/702, 343/793, 818
See application file for complete search history.

(56) References Cited

U.S. PATENT DOCUMENTS 6,281,851 B1 * 8/2001 Tay et al. ..... 343/702
7,081,854 B2 * 7/2006 Ying et al. ..... 343/702
2005/0057407 A1 * 3/2005 Imaizumi et al. ..... 343/702

OTHER PUBLICATIONS

U.S. Appl. No. 11/027,308, filed Dec. 30, 2004, Faraone et al.

* cited by examiner

*Primary Examiner*—Shih-Chao Chen

(57) ABSTRACT

An electronic device (400) enabled to receive radio frequency signals can comprise a housing (405), a PCB (110) enclosed in the housing (100), an antenna (115) coupled to the PCB (110) and enabled to receive the radio frequency signals and a choke (125) coupled to the PCB (110) and enabled to suppress radio frequency currents flowing on the PCB (110). As an example, the frequency at which the choke (125) suppresses the currents can be at a GPS signal frequency.

15 Claims, 6 Drawing Sheets

400

ELECTRONIC DEVICE TO RECEIVE RADIO FREQUENCY SIGNALS

BACKGROUND OF THE INVENTION

1. Field of Invention

The present invention relates to electronic devices enabled to receive radio frequency signals. Furthermore, the present invention relates to a communication device enabled to receive Global Positioning System (GPS) signals.

2. Description of Related Art

Some electronic devices suffer from poor performance because of inherent antenna patterns, which feature nulls pointing upward. For example, a GPS antenna pattern observed in a handheld electronic device can comprise a main lobe and a secondary lobe. In existing handheld electronic devices, which use a main subscriber antenna for GPS reception, the main lobe of the GPS antenna pattern is pointed downward. The GPS antenna pattern can feature a null pointing upward, which reduces the link margin with GPS satellites transmitting from the upper hemisphere, assuming that the electronic device is in a substantially vertical position. The null in the antenna pattern can be produced by the strong radio frequency (RF) currents that flow in a ground plane of the handheld electronic device when a monopole like GPS antenna is used.

In view of the above, GPS reception on many products may not satisfy the desired specifications. This can prevent the reliable operation of GPS enabled devices. Better performance can allow running numerous GPS applications on electronic devices, such as mobile phones, and can improve overall user experience by enabling features like GPS navigation and other location-related applications.

SUMMARY OF THE INVENTION

An embodiment of the present invention relates to an electronic device enabled to transmit or receive radio frequency signals. The electronic device can comprise a housing, a printed circuit board (PCB) enclosed in the housing, an antenna coupled to the PCB and a choke coupled to the PCB. The antenna can be enabled to receive the radio frequency signals. The choke can be enabled to suppress radio frequency currents flowing on the PCB. The electronic device can further comprise a parasitic element coupled to the antenna, such that the parasitic element may resonate at an operating frequency (e.g., of a GPS signal) of the electronic device. The parasitic element can further be coupled at a position substantially orthogonal to the antenna such that the parasitic element can provide an electrical counterpoise to the antenna, thus forming a V-shaped dipole, which can effectively act as a receiving antenna element. The choke can electrically isolate the antenna element from the PCB.

The choke can be constructed such that the choke at least substantially isolates the antenna from signals generated by components on the PCB. This process can improve the signal-to-noise and interference ratio of, for example, a GPS receiver. The choke can be further enabled to suppress or mitigate the effects of radio frequency currents when a user grasps the electronic device with the user's hand. The choke can be electrically coupled to at least one point on the PCB. The choke can be a quarter wavelength choke at, for example, a GPS signal frequency and can be comprised of metal that may be part of the housing of the electronic device. The operating frequency of the electronic device can be a global positioning system frequency. The electronic device can be a monolith wireless communications device. A monolith wireless communication device can be defined as a communication unit built within a single integrated housing.

In another embodiment of the present invention, a communication device is provided. The communication device can comprise an antenna, a parasitic element coupled to the antenna and a PCB. The antenna can be coupled to the PCB. The antenna and the parasitic element can form a dipole. The antenna can be configured to at least receive signals from a global positioning system satellite. The communication device can further comprise a radio frequency choke. The radio frequency choke can further isolate the dipole from the PCB, such as at a GPS signal frequency. The radio frequency choke can be selectively coupled to the PCB. The communication device can further comprise a housing. As an example, the radio frequency choke can be comprised of metal that can be part of the housing. Radio frequency currents may be generated on the PCB when the communication device is operating, and the radio frequency choke can be configured to at least substantially suppress the radio frequency currents generated on the PCB. Suppressing the radio frequency currents generated on the PCB can result in a stronger signal reception, as compared to a communication device without the radio frequency choke.

BRIEF DESCRIPTION OF THE DRAWINGS

The features of the present invention, which are believed to be novel, are set forth with particularity in the appended claims. The invention, together with further objects and advantages thereof, may best be understood by reference to the following description, taken in conjunction with the accompanying drawings, in the several figures of which like reference numerals identify like elements.

DETAILED DESCRIPTION OF THE INVENTION

Figure 1:
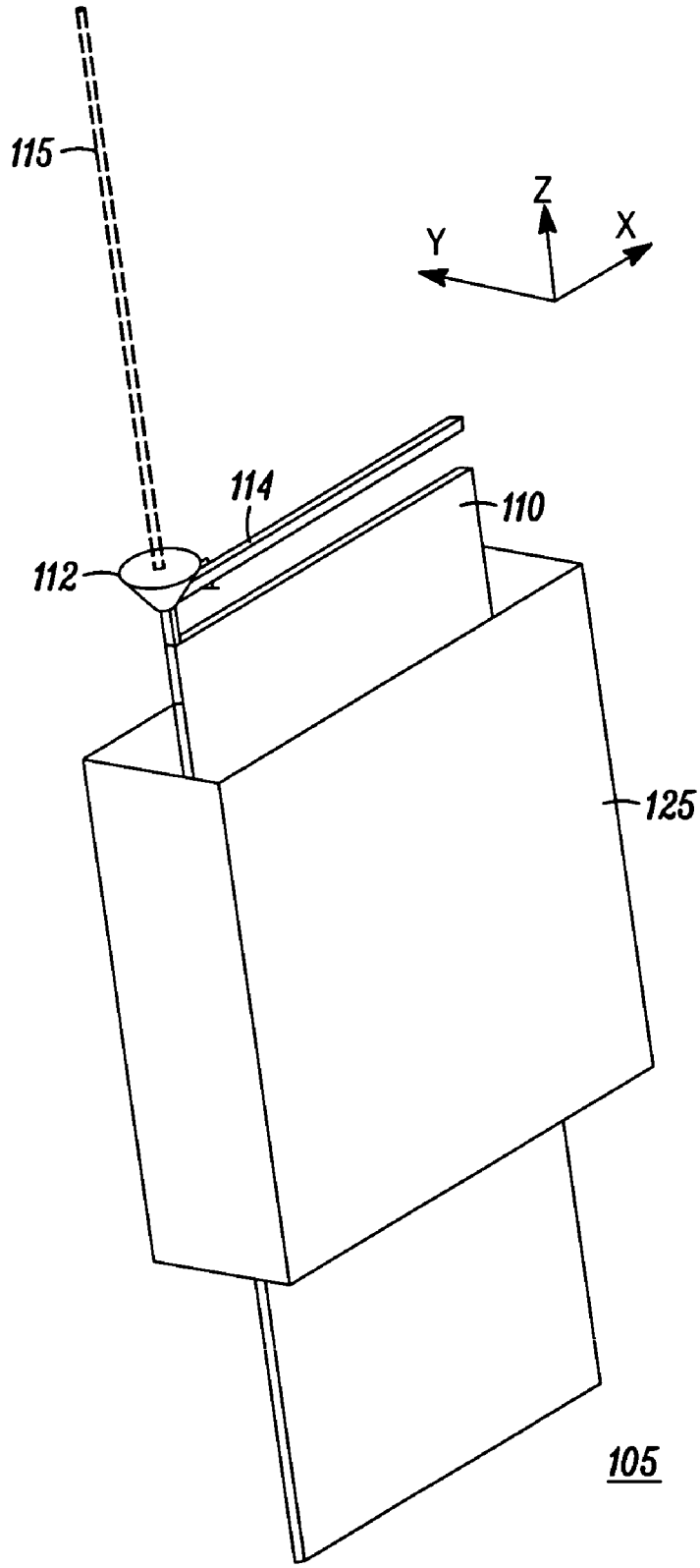
FIG. 1 illustrates an example of an antenna system having a radio frequency choke in accordance with an embodiment of the inventive arrangements.

While the specification concludes with claims defining the features of the invention that are regarded as novel, it is believed that the invention will be better understood from a consideration of the following description in conjunction with the drawing figures, in which like reference numerals are carried forward.

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting but rather to provide an understandable description of the invention.

The terms "a" or "an", as used herein, are defined as one or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically. The terms "program", "software application", and the like as used herein, are defined as a sequence of instructions designed for execution on a computer system. A "program", "computer program", or "software application" may include a subroutine, a function, a procedure, an object method, an object implementation, an executable application, an applet, a servlet, a source code, an object code, a shared library/dynamic load library and/or other sequence of instructions designed for execution on a computer system.

The present invention relates to an electronic device enabled to receive radio frequency signals. Furthermore, the present invention relates to a communication device enabled to receive GPS signals, which enable a user to use the communication device with uniform coverage and improved signal reception.

An embodiment of the present invention provides an electronic device to receive radio frequency signals. The electronic device can comprise a housing, a printed circuit board (PCB) enclosed in the housing, an antenna coupled to the PCB and enabled to receive the radio frequency signals and a choke coupled to the PCB. The present invention can control the antenna pattern by introducing an electrical counterpoise to the antenna element and suppressing the radio frequency (RF) current flowing from the components on the PCB to the antenna of the electronic device through the use of the choke. As an example, the choke can be implemented using the metal parts of the housing of the electronic device, and the choke can substantially enclose a part of the PCB of the electronic device. As another example, the choke can be positioned close to the edge of the PCB, near the antenna. That is, the choke can be isolated from the PCB at the top of the housing of the electronic device near the location of the antenna.

The choke can be shorted at a point on the PCB to provide an operation similar to that of a quarter wavelength balun. In the given condition, the antenna operation can be affected since the antenna operation relies on the ground plane. To avoid the effect of the ground plane on the operation of the antenna, a parasitic element can be introduced at the top of the antenna, which can resonate at an operating frequency of the electronic device. The parasitic element can be constructed using a metal. The antenna and the parasitic element can form a V-shaped dipole. The choke can be used to isolate the V-shaped dipole from the rest of the electronic device, as the choke can suppress the radio frequency currents flowing from the components on the PCB to the antenna. The effects on radio frequency currents induced into the housing of the electronic device when a user holds the electronic device can be mitigated, in view of the invention, which can improve the performance of the antenna.

Turning now to FIG. 1, an example of an antenna system 105 is shown. X, Y and Z references are drawn for reference, which may be helpful in describing certain figures to be described below. The antenna system 105 can include a main antenna 115, which can be coupled to a printed circuit board (PCB) 110 having a ground plane. As an example, the antenna 115 can be coupled to the PCB 110 through a feed point 112. As an example, the antenna 115 can be in the form of a single bar antenna or other structure capable of sending and/or receiving wireless communications signals. In particular, the antenna 115 may include helix, double helix or monopole designs or designs with extendable arms.

In one arrangement, the antenna system 105 can also include a parasitic element 114, which can be coupled to the antenna 115 in approximately or substantially an orthogonal arrangement. This coupling can enable the antenna 115 and the parasitic element 114 to resonate together to send and/or receive wireless communications signals. That is, the antenna 115 and the parasitic element 114 can resonate at an operating frequency or frequencies of a wireless device. As an example, the operating frequency can be a GPS signal frequency, although the invention is not so limited. The parasitic element 114 may not be actively driven by a transceiver that is coupled to the antenna 115, as the element 114 may be passively coupled to the antenna 115 and the PCB 110 having the ground plane, which can substantially reduce the RF current flowing on the ground plane of the PCB 110. The orthogonal relationship between the antenna 115 and the parasitic element 114 can approximate what is known in the art as a V-shaped dipole, which can create an omni-directional radiation pattern substantially without nulls. It is important to note that the antenna system 105 can function without the parasitic element 114, if so desired.

The antenna system 105 can also include a choke 125, which can be an RF choke. The choke 125 can be used to suppress RF currents flowing on the PCB 110. In particular, the choke 125 can isolate the antenna 115 and the parasitic element 114 (e.g., the V-shaped dipole) from the PCB 110. As such, the choke 125 can isolate the antenna 115 and the parasitic element 114 from signals generated by electrical components on the PCB 110. In one arrangement, the choke 125 can suppress the RF currents at the operating or resonating frequency or frequencies of the antenna 115 and the parasitic element 114, which, as an example, can be a GPS signal frequency. In one arrangement, the choke 125 can be positioned as close to the top of the edge of the PCB 110 as possible or otherwise as close to the antenna 115 and parasitic element 114 as possible. Of course, the invention is not limited to this particular configuration.

The choke 125 may be at least substantially constructed of metal; it is not required that it be made solely of metal, however. Also, the choke 125 is not limited to being a solid piece of material, as it can include any suitable number of pieces and can even be of a mesh-like construction. Although FIG. 1 shows the choke 125 as being completely wrapped around the PCB 110, it must be understood that the choke 125 is not limited to such a design. In fact, the choke 125 can be of any suitable configuration, so long as it suppresses RF currents on the PCB 110 at the operating frequency of the antenna 115 and the parasitic element 114.

In one particular arrangement, the length of the choke 125, which runs essentially parallel to the PCB 110, can be a certain fraction of the wavelength of the wireless signal of the operating frequency of the antenna 115 and the parasitic element 114. For example, the length of the choke 125 can be one-fourth of the wavelength of a signal at a GPS frequency. As such, the choke 125 can provide an operation that is similar to that of a quarter wavelength balun.

Figure 2:
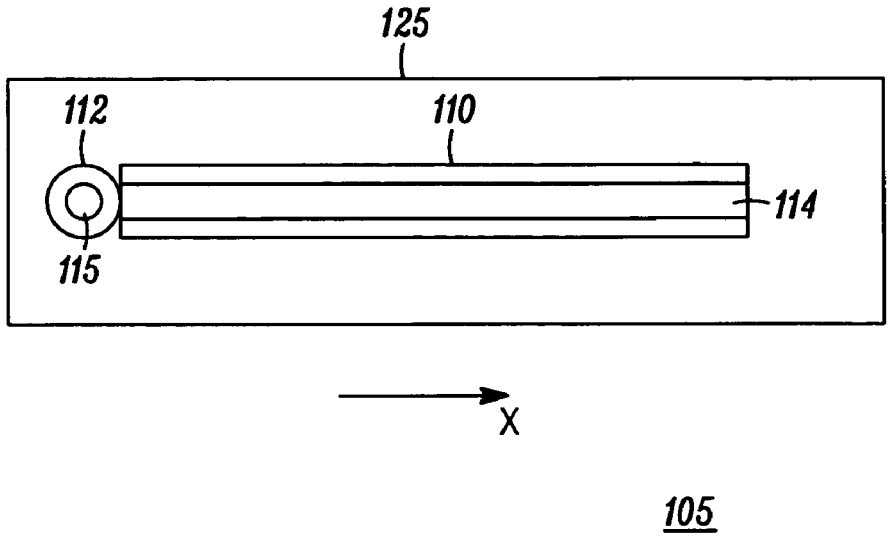
FIG. 2 illustrates a top view of the antenna system of FIG. 1 in accordance with another embodiment of the inventive arrangements.
Figure 3:
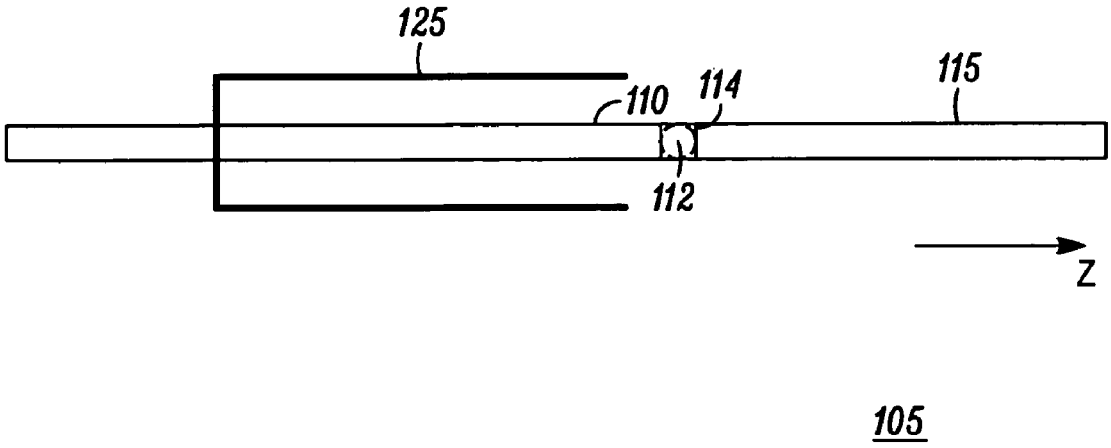
FIG. 3 illustrates a cross-sectional view of the antenna system of FIG. 1 in accordance with an embodiment of the inventive arrangements.

Referring to FIG. 2, a top or bird's-eye view of the antenna system 105 is shown. Also, referring to FIG. 3, a cross-sectional view of the antenna system 105 is shown. Reference arrows respectively designating the X and Z axes have been provided for convenience. As can be seen in FIG. 2, the choke 125 can at least substantially enclose the PCB 110, although such a configuration is not necessary. Also, although the parasitic element 114 is shown as having a length that is roughly the same as that of the PCB 110, the invention is not so limited. As can be seen in FIG. 3, the choke 125 can be electrically coupled to the ground plane of the PCB 110. The choke 125 can be coupled to the PCB 110 at any suitable number of locations on the PCB 110. In one arrangement, the choke 125 can be coupled to the PCB 110 at an end that is opposite to the end of the choke 125 that is near the top of the PCB 110.

Figure 4:
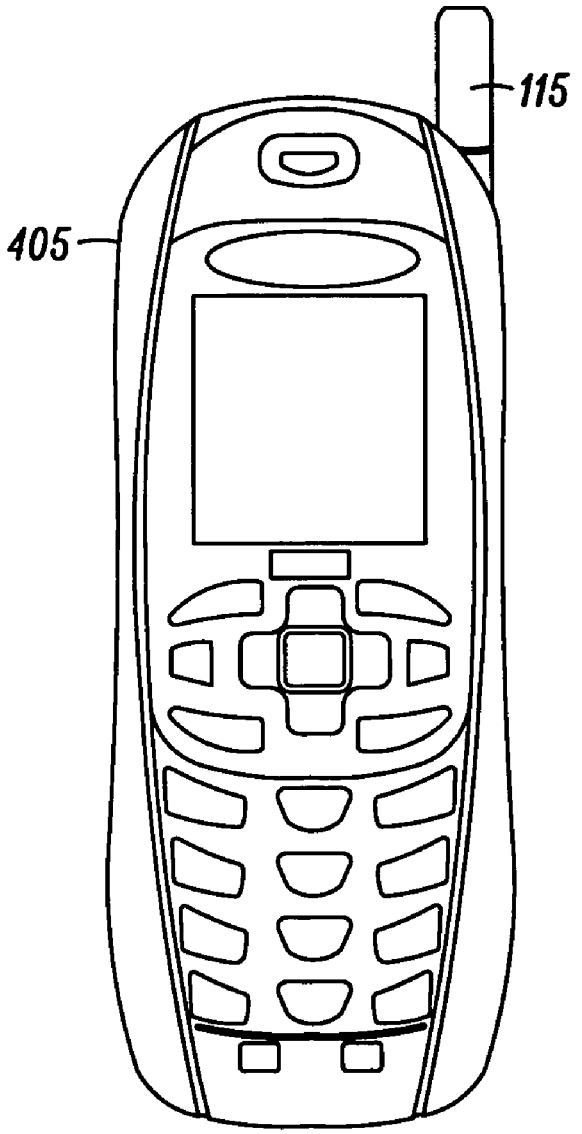
FIG. 4 illustrates an example of an electronic device that can include the antenna system of FIG. 1 in accordance with an embodiment of the inventive arrangements.

Referring to FIG. 4, a communication device 400 is shown. In one arrangement, the device 400 can be a wireless handset that can include the antenna system 105 of FIG. 1. As an example, the device 400 can be a monolith wireless communication device. A monolith wireless communication device can be a communication device built within a single integrated housing. It is understood, however, that the antenna system 105 can be implemented in other suitable communication devices.

The device 400 can include a housing 405, which may enclose PCB 110 of the antenna system 105. In addition, the antenna 115 can be used to receive wireless signals, such as GPS frequency signals. In one arrangement, the parasitic element 114 can be positioned on an inside surface (not shown) of the housing 405. Alternatively, it can be positioned on the PCB 110 or even on an outside surface of the housing 405. In another arrangement, the choke 125 can be constructed of metal that may form part of the housing 405.

The device 400 is typically grasped by a user's hand when it is being used. This grasping may affect the operation of the antenna 115 in some prior art models. Here, however, in view of the choke 125, the operation of the antenna 115 may be minimally affected when a user grasps the device 400.

Figure 5:
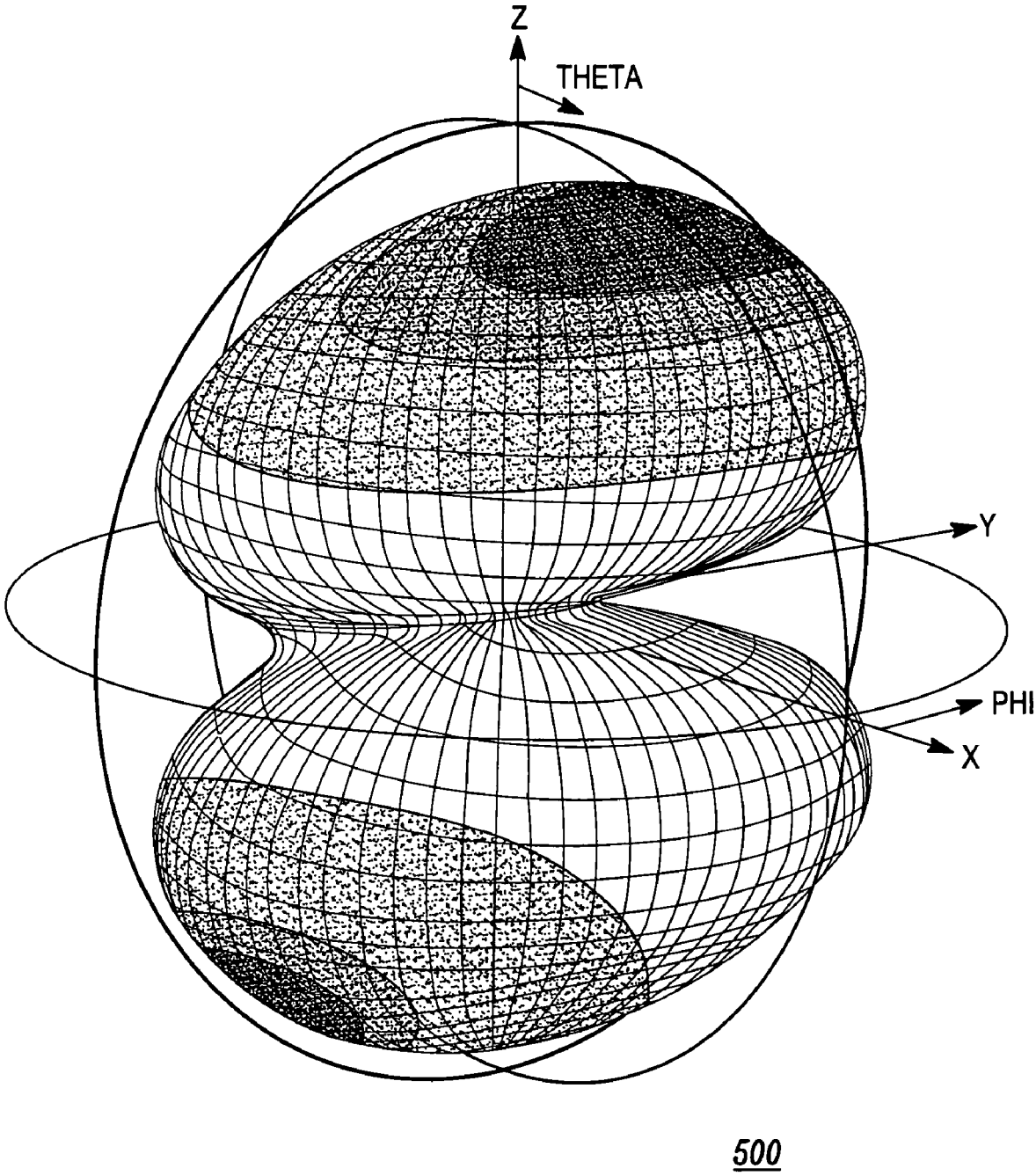
FIG. 5 illustrates an example of a radiation pattern associated with the antenna system of FIG. 1 in accordance with an embodiment of the inventive arrangements.

Referring to FIG. 5, an example of a radiation pattern 500 that is generated from the communication device 400 of FIG. 4 having the antenna system 105 of FIG. 1 is shown. As an example, this radiation pattern 500 can be generated at a GPS signal operating frequency of the device 400 and the X, Y and Z-axes can relate to the X, Y and Z-axes of FIG. 1. As can be seen, the radiation pattern 500 is not exhibiting any nulls in the Z-axis direction and can result in a stronger signal reception as compared to a communication device without the choke 125 (see FIG. 1). In the communication device 400 of FIG. 4, the Z-axis direction is important for signal strength, as the device 400 may be held in a manner such that the antenna 115 (see FIG. 1) is positioned in this direction when receiving signals from one or more GPS satellites.

Figure 6:
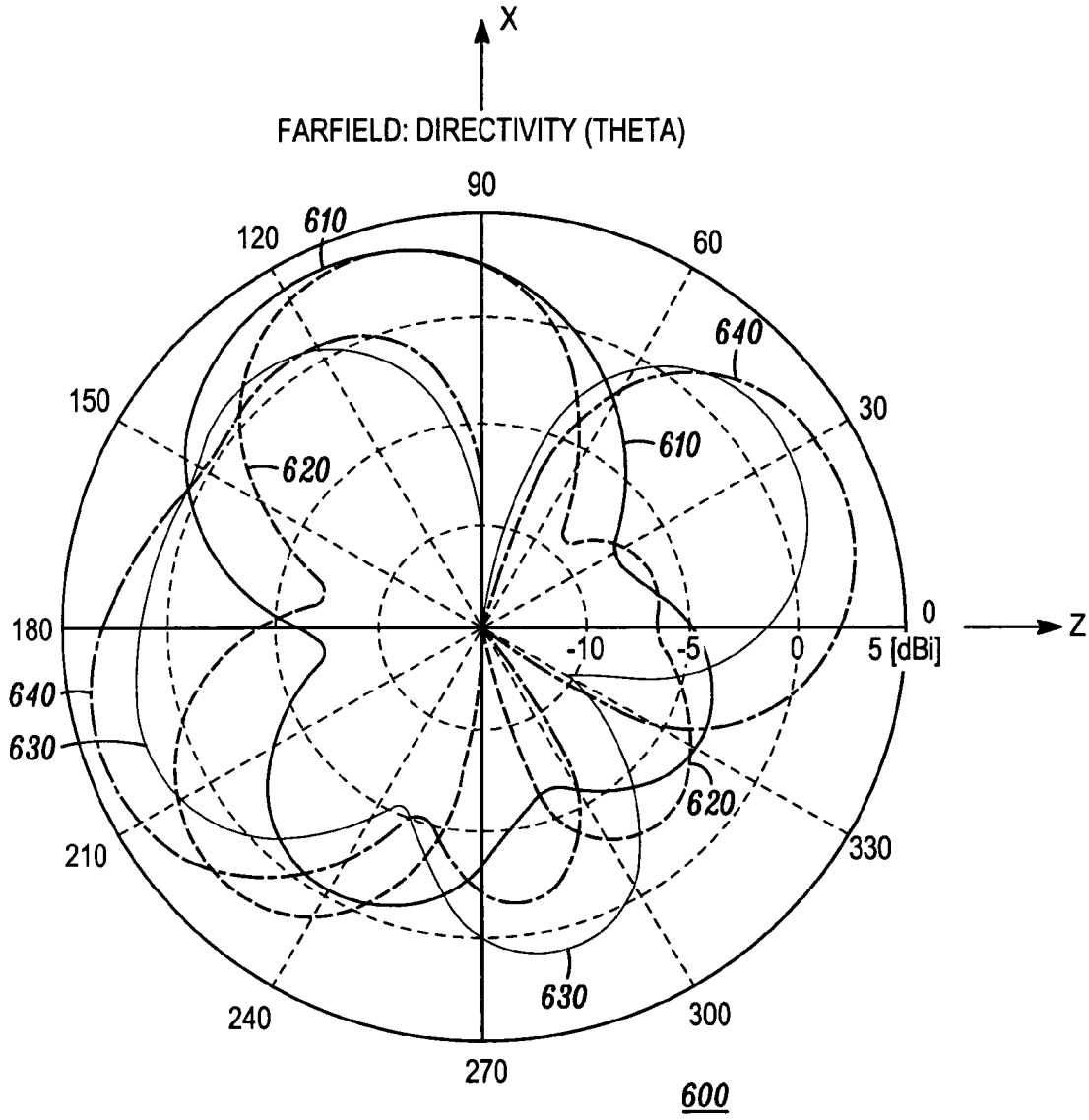
FIG. 6 illustrates a polar plot associated with the antenna system of FIG. 1 in accordance with the inventive arrangements.
Figure 7:
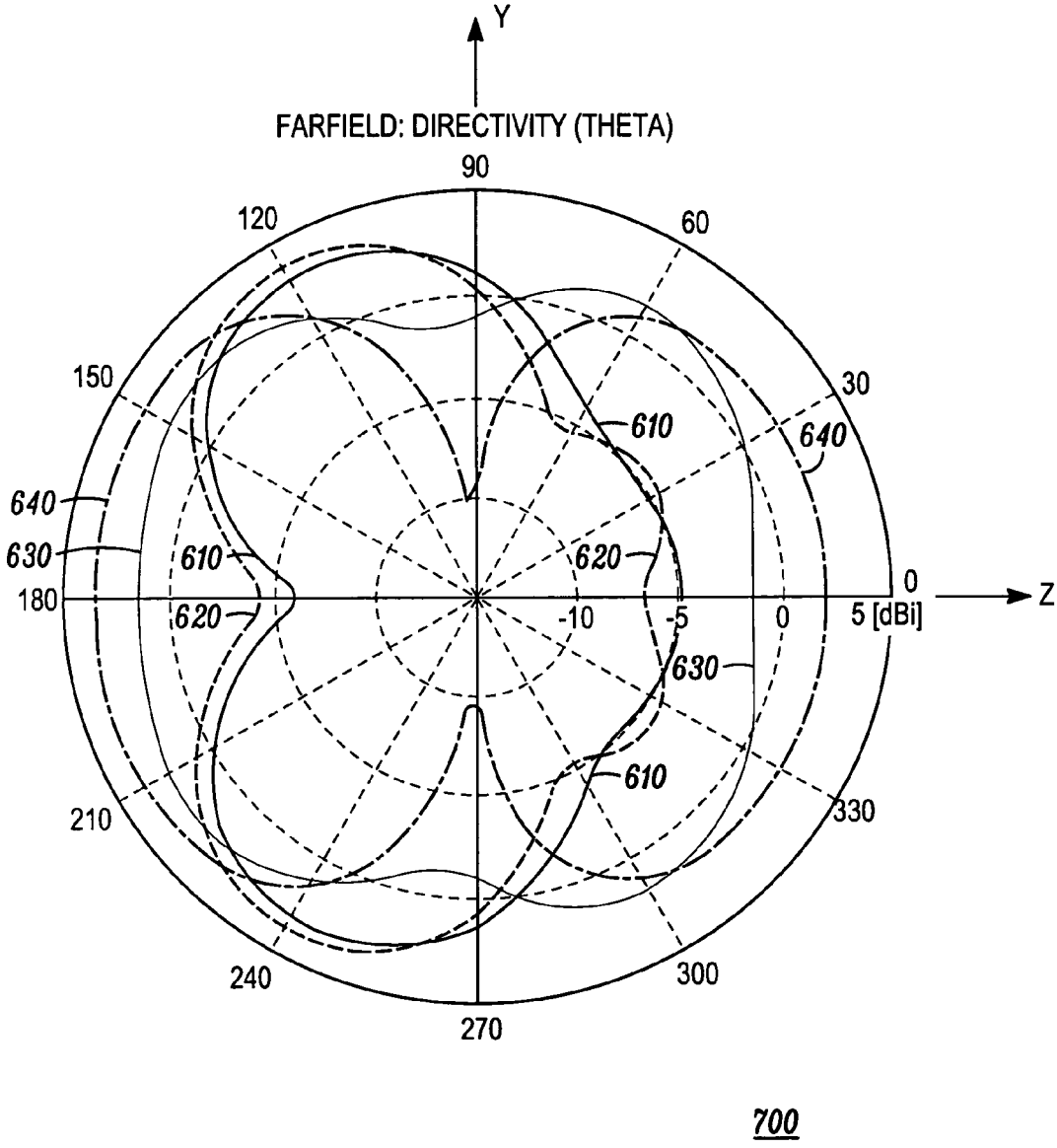
FIG. 7 illustrates another polar plot associated with the antenna system of FIG. 1 in accordance with the inventive arrangements.

Referring to FIGS. 6 and 7, respective polar plots 600, 700 are shown. These polar plots 600, 700 represent graphs of various prior art antenna systems and the inventive antenna system 105 of FIG. 1. The polar plots 600, 700 include cuts of a pattern 610 that represents the directivity of an inverted-F antenna, a pattern 620 that represents the gain of a monopole antenna and a pattern 630 that represents the gain of a V-shaped dipole antenna obtained by using the parasitic element without a choke. The pattern 640 can represent the gain for the antenna system 105 of FIG. 1.

Referring to the polar plot 600 of FIG. 6, the X-axis is pointing towards the top of the graph, and the Z-axis is pointing towards the right of the graph. The Y-axis comes out of the center of the graph. These axes are related to the axes shown in FIGS. 1-3 and 5. Referring to polar plot 700 of FIG. 7, the Y-axis is pointing towards the top of the graph, and the Z-axis is pointing to the right of the graph. The X-axis is pointing into the center of the graph. Again, these axes are related to the axes shown in FIGS. 1-3 and 5. As can be seen in both plots 600, 700, incorporation of the choke 125 for suppressing the RF current flowing in the PCB 110 of the electronic device 400 can increase the gain of the GPS signal reception across the upper hemisphere, indicated by the Z-axis.

This disclosure is intended to explain how to fashion and use various embodiments in accordance with the invention rather than to limit the true, intended and fair scope and spirit thereof. The foregoing discussion is not intended to be exhaustive or to limit the invention to the precise forms disclosed. Modifications or variations are possible in the light of the above teachings. The embodiment(s) was chosen and described to provide the best illustration of the principles of the invention and practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally and equitably entitled.

What is claimed is:

1. An electronic device enabled to at least receive radio frequency signals, the electronic device comprising:

a housing;

a printed circuit board (PCB) enclosed in the housing;

an antenna coupled to the PCB and enabled to receive the radio frequency signals;

a choke coupled to the PCB and enabled to suppress radio frequency currents flowing on the PCB; and a parasitic element coupled to the antenna, wherein the parasitic element and the antenna form an approximately V-shaped dipole.

2. The electronic device of claim 1, wherein the parasitic element resonates at an operating frequency of the electronic device.

3. The electronic device of claim 2, wherein the parasitic element is coupled substantially orthogonal to the antenna.

4. The electronic device of claim 2, wherein the operating frequency is a global positioning system frequency.

5. The electronic device of claim 1, wherein the choke electrically isolates the dipole from the PCB.

6. The electronic device of claim 1, wherein the electronic device is a monolith wireless communications device.

7. The electronic device of claim 1, wherein the choke is also constructed to at least substantially isolate the antenna from signals generated by components on the PCB.

8. The electronic device of claim 1, wherein the choke is further enabled to suppress radio frequency currents when a user grasps the electronic device with the user's hand.

9. The electronic device of claim 1, wherein the choke is electrically coupled to at least one point on the PCB.

10. The electronic device of claim 1, wherein the choke is a quarter wavelength choke.

11. The electronic device of claim 1, wherein the choke is comprised of metal that is part of the housing.

12. A communication device, comprising:

an antenna that receives signals from a global positioning system satellite;

a parasitic element coupled to the antenna;

a printed circuit board (PCB), wherein the antenna is coupled to the PCB and wherein radio frequency currents are generated on the PCB when the communication device is operating; and a radio frequency choke selectively coupled to the PCB, wherein the radio frequency choke is configured to at least substantially suppress the radio frequency currents generated on the PCB, which results in a stronger signal reception as compared to a communication device without the radio frequency choke;

wherein the parasitic element and the antenna form an approximately V-shaded dipole.

13. The communication device according to claim 12, further comprising a housing, wherein the radio frequency choke is comprised of metal that is part of the housing.

14. The communication device according to claim 12, wherein the radio frequency choke further isolates the dipole from the PCB.

15. The communication device according to claim 12, wherein the parasitic element is coupled substantially orthogonal to the antenna.

* * * * *